United States Patent [19]

Tech

[11] 4,088,836

[45] May 9, 1978

[54] ACOUSTICALLY RESPONSIVE SIGNAL INJECTION SYSTEM FOR HEADPHONE USERS

[75] Inventor: Donald D. Tech, S. Chelmsford, Mass.

[73] Assignee: Antech Industries, S. Chelmsford, Mass.

[21] Appl. No.: 798,107

[22] Filed: May 18, 1977

[51] Int. Cl.[2] ..... H04R 3/00

[52] U.S. Cl. ..... 179/1 MN

[58] Field of Search ..... 179/1 R, 1 P, 1 MN, 179/1 VC

*Primary Examiner*—George G. Stellar

*Attorney, Agent, or Firm*—Woodcock, Washburn, Kurtz & Mackiewicz

[57] ABSTRACT

A gated oscillator is coupled to a set of headphones through a connector interposed between the headphone plug and a mating jack in a stereo receiver or other source of audio information. An acoustic pickup is coupled to the oscillator through circuitry which establishes a threshold for the oscillator. When a sound sufficiently loud to exceed a threshold is detected by the pickup, the oscillator is actuated and superimposes an audible tone on the audio information.

14 Claims, 1 Drawing Figure

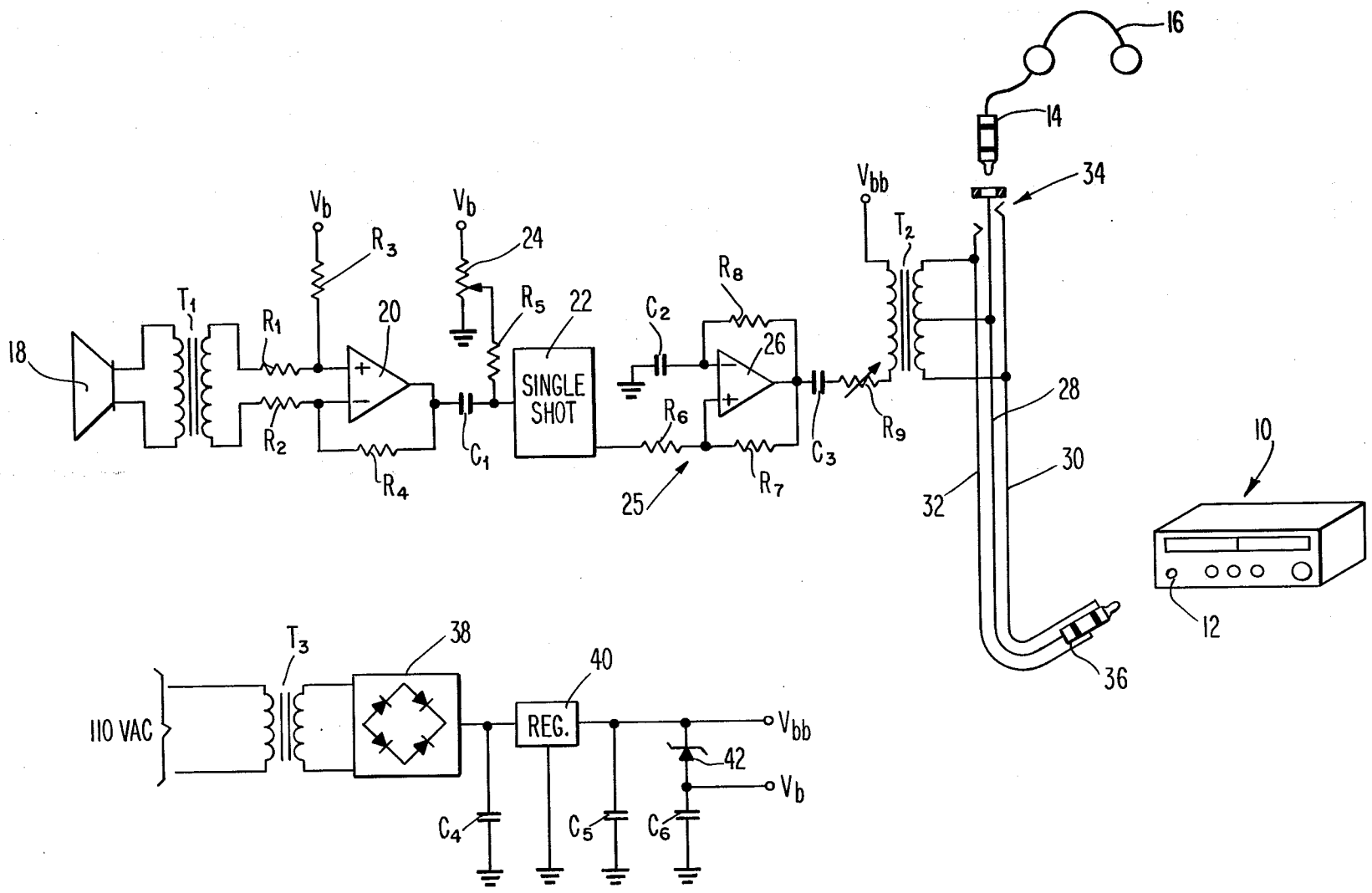
10
12
16
14
34
28
30
36
32
$T_2$
$V_{bb}$
$R_9$
$C_3$
$R_8$
26
$R_7$
$C_2$
$R_6$
25
22
SINGLE SHOT
24
$R_5$
$V_b$
$C_1$
20
$R_4$
$R_3$
$V_b$
$R_1$
$R_2$
$T_1$
18
$V_{bb}$
$V_b$
42
$C_6$
40
REG.
$C_5$
38
$C_4$
$T_3$
110 VAC

ACOUSTICALLY RESPONSIVE SIGNAL INJECTION SYSTEM FOR HEADPHONE USERS

BACKGROUND OF THE INVENTION

The present invention relates to headphone systems of the type used with home entertainment systems, and more particularly to means for producing an alarm to be perceived by the headphone user.

Of the many types of stereo receivers, radio receivers, and record, disk and tape amplifier systems available, most are adapted to be used with headphones. Although the fidelity and a general quality of the audio information produced by such units is in many cases extremely good, many people find that appreciation of the fidelity and quality of the system can be best appreciated when using headphones in order to shield the desirable sound from ambient noises. Further, in many cases it is practically required that headphones be used especially when other activites prevent an individual from playing his receiver or the like aloud; or to allow others to engage in activity which would normally make it impossible for one to listen to his receiver or playback unit.

Accordingly, increasingly sophisticated headphones have been developed to fulfill the above-described needs. Recent headphone development efforts have been principally in two areas; firstly, to provide fidelity which will at least match that of the audio equipment to which the headphones are coupled; and secondly, the ability of the headphones to block out ambient noise as completely as possible.

To a great extent, both of these criteria have been met. High-quality headphones are available whose fidelity substantially matches, or exceeds, that of stereo receivers and playback units. In addition, a considerable amount of research and experimentation has produced headphones which block out ambient sound to an extraordinary degree.

Achievement of these goals has contributed a great deal to the enjoyment of stereophonically reproduced music and the like. Ironically, however, the achievement of these very goals has created a problem inasmuch as the better the noise-blocking qualities of the headphones, the more oblivious the user is to ambient sounds which he might otherwise wish to hear. For instance, a headphone user is often oblivious to a knock upon the door, or a doorbell ringing; and oftentimes cannot hear a telephone ringing or a child calling from a distant part of a house or an apartment. More importantly, he may also be oblivious to otherwise audible alerting signals, such as a fire alarm.

Accordingly, it will be seen that it would be highly desirable to provide means for alerting an individual to the occurrence of some unusual ambient sound, allowing him to temporarily remove the headphones and direct his attention to the source of the sound.

It is therefore an object of the present invention to provide means for alerting a headphone user to the occurrence of a substantial or unusual noise.

Another object is to provide a method of directing an alarm signal to a set of headphones in response to a perceived, unusual noise.

Yet another object is to provide means for superimposing an acoustic alarm signal upon audio information directed to a pair of headphones in response to the detection of a sound having a volume greater than some predetermined value.

SUMMARY OF THE INVENTION

Briefly stated, in accordance with one aspect of the invention the foregoing objects are achieved by providing an acoustic pickup transducer for detecting ambient sound, and coupling thereto a source of audio-frequency oscillations which is responsive to detected sounds over some predetermined minimum value. A coupling is interposed between the plug from a pair of headphones and the mating phone jack of a source of audio information, which allows information to continue to be coupled to the headphones. The output of the audio-frequency oscillator is also coupled to the connecting means for introducing an audible signal into the headphones upon the detection of an ambient sound which exceeds some threshold value.

BRIEF DESCRIPTION OF THE DRAWING

While the specification concludes with claims particularly pointing out and distinctly claiming the subject matter which is regarded as the invention, it is believed that the invention will be better understood from the following description of a preferred embodiment taken in conjunction with the accompanying drawing in which the FIGURE represents a schematic illustration of a presently preferred embodiment of the invention.

DESCRIPTION OF A PREFERRED EMBODIMENT

A source of audio information 10, which will ordinarily be a stereo receiver, phonograph amplifier or the like, is provided with a phone jack 12 adapted to receive the plug 14 of a pair of headphones designated 16. As is well known, headphones are commonly used to enhance the enjoyment of stereo sound systems, their primary function being to block out ambient noise. The term "ambient noise" will be used herein to designate sounds occurring in the surroundings of a headphone user. Such noise may be considered to include any sort of sounds which normally occur such as individuals talking, the sounds of appliances or automobiles, radios, televisions, and the like. Hence "ambient noise" refers to the totality of sounds in the environment under consideration, rather than to any specific average noise level.

It will be understood that, depending upon the type and quality of headphones 16, a user is substantially unaware of ambient noises. Hence he may not hear the sounds of a telephone ringing, cries of alarm, a knock on the door or a doorbell, and so on. Ironically, the better the quality of the headphone, the more immune the user will be from sounds which he would otherwise wish to hear.

In order that the user of headphones 16 may be alerted to certain ambient sounds, an acoustic pickup transducer 18, which may be a small speaker of an ordinary type, is coupled to an amplifier 20 by means of a transformer $T_1$. In a presently preferred embodiment the amplifier comprises a type 741 integrated circuit. The amplifier is connected to the transformer through resistors $R_1$ and $R_2$, with another resistor $R_3$ coupling the positive input terminal of amplifier 20 to a source of biasing potential $V_b$. A feedback resistor $R_4$ is coupled from the negative input of the amplifier to its output to provide the amplifier with an appropriate gain factor.

Amplifier 20 is A.C. coupled to a single shot circuit 22 by means of capacitor $C_1$. In a successfully tested embodiment the single shot comprises a 9601 integrated circuit module, connected to afford a period of approximately 0.5 seconds. The 9601 integrated circuit is triggered by a voltage exceeding some predetermined limit.

In order that the limit, or threshold, of single shot circuit 22 may be adjusted a potentiometer 24 is provided, and coupled between the source of biasing potential $V_b$ and ground. The slider of the potentiometer is connected to the input terminal of single shot circuit 22 through an appropriate resistor $R_5$. In this manner the D.C. bias upon the input terminal of the single shot circuit can be varied in order to determine the volume or "loudness" of an ambient noise which is required to trigger the single shot circuit.

When single shot 22 is triggered it supplies a positive-going signal to an oscillator generally indicated at 25. In the illustrated embodiment the oscillator includes another type 741 operational amplifier 26. The output of single shot 22 is coupled to the positive input of amplifier 26 through resistor $R_6$, and a feedback loop comprising a resistor $R_7$ is established from the output of the amplifier to the latter input terminal.

A capacitor $C_2$ is coupled between the negative input terminal of the amplifier and ground, and a second feedback path established by means of a resistor $R_8$ coupled from the output to the negative input terminal of amplifier 26 to support the regenerative feedback necessary for oscillation. Finally, another capacitor $C_3$ couples the output of the oscillator circuit to an output transformer $T_2$ through an adjustable resistor $R_9$.

The output transformer comprises a primary winding coupled to a source of potential $V_{bb}$, and exhibiting a relatively low, e.g. 8 ohms, impedance. The secondary or output winding of transformer $T_2$ is center tapped as shown and exhibits a substantially high, e.g. 1000 ohms, impedance for reasons to be explained hereinafter. The center tap of the secondary winding is coupled to the ground conductor 28 of a connecting means adapted to be interposed between phone plug 14 and jack 12. Opposing ends of the secondary winding of transformer $T_2$ are coupled to conductors 30 and 32. As will be appreciated by those skilled in the art, a ground or reference conductor and a pair of signal conductors are necessary for transmitting stereophonic signals. The conductors terminate at one end in a jack schematically indicated at 34, which may be a common accessory item. The opposite ends of the conductors are coupled to a phone plug 36. Accordingly, the connecting means may easily be interposed between plug 14 and jack 12 inasmuch as plug 36 may be inserted at the jack 12, while jack 34 receives headphone plug 14. In this manner audio information signals from stereo 10 can be transmitted undisturbed to headphones 16.

To complete the schematically illustrated system, a power supply is provided. An input transformer $T_3$ is coupled to a source of line potential, which may be 110-volt A.C. This source may comprise the switched or the unswitched outputs commonly provided in stereo receivers. The A.C. current derived from transformer $T_3$ is rectified by means of a bridge rectifier or the like 38 and applied to an appropriate D.C. regulator 40 after having been filtered by means of an appropriate filter capacitor $C_4$. The regulator output is again filtered by capacitor $C_5$ and forms biasing potential $V_{bb}$. In a successfully tested embodiment the regulator 40 comprises a 12-volt D.C. regulator, so that voltage $V_{bb}$ is established at a level of 12 volts. A second biasing potential $V_b$, which may be 5 volts, is established at the intersection of a Zener diode 42 and capacitor $C_6$, as shown. The present power supply is shown by way of example, it being apparent that other forms of power supplies may be used. It may for example be desired to utilize one or more batteries for energizing the system, or a part thereof.

In operation phone plug 36 is inserted into jack 12 of the stereo unit, and phone plug 14 of the headphones is inserted into jack 34. Acoustic signals from stereo receiver 10 can now be transmitted to headphones 16. The slider of potentiometer 24 is adjusted to an appropriate threshold level so that normally-occurring ambient noises do not trigger single shot circuit 22. Consequently, oscillator 25 remains inoperative and the user of the headphones hears only signals from stereo receiver 10.

Consider now that an unusually loud sound occurs, such as the ringing of a telephone. The unusually loud, ambient sound is transmitted through transducer 18 and input transformer $T_1$ to the terminals of amplifier 20. The voltage across capacitor $C_1$ then changes to a point where, taken in conjunction with the voltage selected by the slider of potentiometer 24, it exceeds the threshold of single shot 22. The single shot is then triggered, and outputs a signal for energizing the gated oscillator 25. The latter then outputs a signal at an audible frequency, for instance 1000 Hz, and couples it to output transformer $T_2$ through capacitor $C_3$ and resistor $R_9$. The amplitude or loudness of the signal is controlled by the value of resistor $R_9$, which may be adjusted to suit the user of the headphones. A 1000 Hz signal then appears upon the conductors leading to headphone 16, superimposing a 1000 Hz signal upon the already-existing sound signal emanating from stereo receiver 10.

The duration of the superimposed sound is, of course, equivalent to the period of single shot 22. The superimposition of the oscillations, perceived as a hum or buzz, alerts the user of the headphones to the fact that some unusually loud sound has occurred and affords him the opportunity of removing the headphones to discover the source of the noise. If the noise persists single shot 22 will be triggered again, and the injected alarm signal will be repeated. If the ambient sound is found to be one of no consequence, but is interfering with enjoyment of the signal from the stereo system, the headphone user has only to readjust potentiometer 24 in order to raise the threshold of the system to a point where the spurious noise will no longer trigger the system. When the noise abates the potentiometer may be readjusted to an appropriate level.

While it will be understood that values of the various circuit components may be varied to suit a particular application, the following values of circuit components are given by way of example:

| | | | |
|---|---|---|---|
| Resistors | | | |
| | $R_1$ | 1000 | Ohms |
| | $R_2$ | 1000 | Ohms |
| | $R_3$ | 47,000 | Ohms |
| | $R_4$ | 47,000 | Ohms |
| | $R_5$ | 5,100 | Ohms |
| | $R_6$ | 150,000 | Ohms |
| | $R_7$ | 150,000 | Ohms |
| | $R_8$ | 150,000 | Ohms |
| | $R_9$ | 0–1000 | Ohms |
| Potentiometer | 24 | 10,000 | Ohms |
| Capacitors | | | |
| | $C_1$ | 1.0 | microfarads |

-continued

| | | |
|---|---|---|
| $C_2$ | 470 | picofarads |
| $C_3$ | 6.8 | microfarads |
| $C_4$ | 100 | microfarads |
| $C_5$ | .1 | microfarads |
| $C_6$ | 15 | microfarads |

The present illustration described a presently preferred embodiment which may be economically manufactured and marketed. It should be understood, however, that other versions of the system are well within the purview of the invention. For instance, it may under some circumstances be desired to provide a switching means for merely interrupting the signal from the source of audio information to the headphones; or to use an average, ambient noise level to establish a dynamic threshold rather than having an absolute reference level which is set by means of a potentiometer or the like, or to amplify sounds which exceed a threshold value and inject them directly into the audio channel. This can easily be done by connecting amplifier 20 to the system output transformer so that an analog of the unusual, loud sound is perceived by the headphone user.

It may also be found economically feasible to combine the substance of the invention into circuitry physically disposed within stereo receiver 10. Such deviations from the presently preferred embodiment should be considered to be within the purview of those skilled in the art, once the present invention is understood. Accordingly, and as will be evident from the foregoing description certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. The method of alerting an individual using headphones actively coupled to an operating source of audio information by a signal conductor, said headphones being of a type which significantly restricts his ability to hear ambient sounds, to the occurrence of a sound having a volume greater than a predetermined minimum value, comprising the steps of:

providing an acoustic pickup transducer for detecting ambient sounds;

providing a signal modifying stage coupled between said signal conductor and said acoustic transducer and responsive to signals from said transducer to substantially modify the audio information being transmitted to said headphones in response to the detection of an ambient sound whose volume exceeds said predetermined value.

2. The method according to claim 1 wherein said signal modifying stage amplifies the said sound having a volume greater than the predetermined value and introduces said sound into said audio information.

3. The method of alerting an individual using headphones actively coupled to an operating source of audio information, said headphones being of a type which significantly restricts his ability to hear ambient sounds, to the occurrence of a sound having a volume greater than a predetermined minimum value, comprising the steps of:

providing an acoustic pickup transducer for detecting ambient sounds;

providing a source of audio-frequency oscillations, said source being coupled to said acoustic transducer and operative to output audio frequency oscillations in response to a detected ambient sound in excess of a predetermined minimum volume; and coupling said oscillation source to the headphones whereby an audio-frequency oscillation signal is superimposed upon said audio information in said headphones when an ambient sound occurs having a volume greater than said predetermined value.

4. The method according to claim 3, further including the step of coupling said oscillation source to a point intermediate to said headphones and said operating source of audio information.

5. The method according to claim 4, further including the step of providing a coupling device having a plug adapted to be coupled to said source of audio information and a jack adapted to be coupled to said headphones, means intermediate to said plug and said jack for coupling audio information from said source of audio information to said headphones, and transformer means for coupling oscillations from said oscillation source to said headphones.

6. The method according to claim 5, wherein said predetermined minimum volume is adjustable.

7. A system for use in conjunction with a pair of headphones coupled by means of a plug and a jack to an operating source of audio information, comprising:

an audio transducer for detecting ambient sound;

oscillator means coupled to said transducer for producing audio-frequency oscillations;

connector means having a jack and a plug and adapted to be interposed between said headphones and said source of audio information, said connector means further including a signal transmitting channel coupling said plug to said jack for transmitting audio information from said source of audio information to said headphones; and means coupling oscillations outputted by said oscillator means to said connector means for introducing an audio-frequency oscillation into said signal transmitting channel.

8. A system according to claim 7, wherein said oscillator means is responsive to signals from said transducer which exceed some predetermined minimum value.

9. The system according to claim 8, further including means for adjusting said minimum value.

10. The system according to claim 9, wherein said means for coupling comprises a transformer having a primary winding coupled to said source of oscillations and a secondary winding coupled to said connector means, the impedance of said primary winding being substantially smaller than the impedance of said secondary winding.

11. A system for use in combination with an operating source of audio information and at least one pair of headphones including a lead and a plug to be driven by said source, comprising:

an acoustic pickup transducer for detecting ambient sounds;

an amplifier;

means coupling said transducer to said amplifier;

a monostable circuit responsive to signals from said amplifier;

an oscillator coupled to said amplifier and responsive to said amplifier output for producing oscillations at an audio-frequency;

means for adjustably determining the minimum value of the output from said amplifier which will cause said oscillator to operate, thus producing oscillations from said oscillator;

connector means adapted to be interposed between said source of audio information and said headphones for transmitting audio information to said headphones; and a second transformer coupling said oscillator to said connector means for applying signals from said oscillator to at least one of said headphones in response to the detection of an ambient sound having a volume greater than a predetermined value.

12. The system according to claim 11, further including a monostable circuit coupled between said first transformer and said oscillator for controlling the period of oscillator operation.

13. The system according to claim 12, further including means for effecting only A.C. coupling between said amplifier and said monostable circuit.

14. The system according to claim 13, further including power supply means adapted to be coupled to a source of A.C. line voltage for outputting a regulated D.C. potential to said amplifier, said monostable circuit, and said oscillator.

* * * * *